United States Patent [19]

Brandigampola

[11] Patent Number: 4,500,888

[45] Date of Patent: Feb. 19, 1985

[54] ANTENNA CONSTRUCTION

[75] Inventor: Don E. Brandigampola, Guelph, Canada

[73] Assignee: Valcom Limited, Guelph, Canada

[21] Appl. No.: 469,946

[22] Filed: Feb. 25, 1983

[51] Int. Cl.[3] ..... H01Q 1/40

[52] U.S. Cl. ..... 343/873; 343/900

[58] Field of Search ..... 343/872, 873, 715, 895, 343/900

[56] References Cited

U.S. PATENT DOCUMENTS

| | | | |
|---|---|---|---|
| 3,102,268 | 8/1963 | Foley | 343/895 |
| 3,725,944 | 4/1973 | Valeriote | 343/873 |
| 4,300,140 | 11/1981 | Brandigampola | 343/873 |

FOREIGN PATENT DOCUMENTS

| | | | |
|---|---|---|---|
| 68703 | 5/1980 | Japan | 343/873 |

*Primary Examiner*—Eli Lieberman
*Assistant Examiner*—Michael C. Wimer

[57] ABSTRACT

A free standing antenna formed with an elongated tubular body portion, having one or more sections, and an enlarged base portion at its lower end for mounting thereof, and the body portion having a plurality of layers or reinforcing filaments, some of the layers being bundles of longitudinal filament rovings running lengthwise, and others of the layers being generally circumferential windings of filament rovings, the layers being bonded together by resin material; electrically conductive elements embedded in the tubular structure, and running from end to end, an annular electrically conductive collar connected to the conductive elements adjacent the lower end of the structure, a female threaded socket connected to the collar, and extending through a wall of the tubular structure for connection from the exterior, at least one layer of woven reinforcing filament cloth material extending up the interior of the tubular structure adjacent the lower end, and overlying the interior of the collar, and, resin bonding the layer of woven cloth material to the interior of the tubular structure, and to the interior of the collar.

4 Claims, 4 Drawing Figures

ANTENNA CONSTRUCTION

The invention relates to antennas, and in particular to the construction of elongated, free-standing antennas made of synthetic materials such as glass reinforced resin materials.

The use of free-standing antennas or so-called "whip" antennas is of great importance in the satisfactory creation of a radio communication system. Such whip antennas are used both on land-based installations, and also extensively on marine vessels, both merchant vessels, commercial vessels and to a large extent military and naval vessels. Such antennas are sometimes of considerable length, and may be constructed in several sections, being joined together by threaded couplings, somewhat in the fashion of a fishing rod. They are of generally speaking continuously tapering construction from the base to the tip, and incorporate suitable conductive elements, for carrying the signals. They are required to operate in all forms of weather, and indeed, in many cases it is of greatest importance that they operate at 100% efficiency during the worst possible weather conditions. They must be capable of repeated and continuous flexing, as a result of wind action, or as a result of wave action in the case of antennas mounted on vessels, without any damage to the antenna. In addition, they must be capable of withstanding the action of extensive exposure to sea water and salt, ice, snow and the like.

In U.S. Pat. No. 3,725,944 (assigned to this applicant) there is disclosed a fiberglass whip antenna of a novel form of construction, which meets many of these objectives more or less satisfactorily, and has in fact achieved wide acceptance for use by government agencies in many nations. However, certain relatively minor shortcomings have developed in unusual circumstances, and certain difficulties have been experienced in manufacture, and the object of the present invention is to overcome these various problems. For example, in the form of antenna disclosed in such patent, it was possible for sea water to enter into the interior of the antenna. As sea water entered and either evaporated or drained out, salt deposits would gradually build up. These salt deposits have been found to cause leakage of the radio signals, causing a certain loss in efficiency.

In addition, the construction of the earlier form of antenna incorporated a conductive ring or cuff which sometimes created problems during the manufacture of the antenna, and which in certain extreme circumstances might become loose or dislodged within the interior of the antenna after particularly severe usage.

In addition, the design of the earlier antenna was such that after continuous repeated stressing or severe whipping action in heavy winds, and wave action, the outside of the antenna appeared to develop hair-line cracks on the surface only. While these cracks did not in any way impair the strength of the antenna, and its ability to withstand continuous whipping action, they did permit the deposit of sea water and salt in the surface. This then caused the development of unsightly spots or marks on the surface of the antenna, causing the users to regard the antenna as suspect, and liable to failure.

It is therefore a general objective of the invention to provide an improved form of whip antenna overcoming these various disadvantages.

BRIEF SUMMARY OF THE INVENTION

With a view to overcoming these problems, the invention provides a free-standing antenna construction having an elongated tubular body portion, and an enlarged base portion at its lower end for mounting thereof, said body portion at least being formed of a plurality of layers of filaments, some said layers of filaments comprising bundles of longitudinal filaments running lengthwise along such body portion, and others of said layers comprising generally circumferential windings of rovings, said layers of rovings being bonded together by resin material, and electrically conductive means embedded in said elongated tubular structure and running generally from end to end thereof, and adjacent said lower end thereof, being connected to a generally annular electrical conductive member, a female threaded metallic socket connected to said annular member, and extending through a wall of said elongated tubular structure, for connection of electrical connection means to the exterior thereof, at least one layer of woven glass fibre cloth material extending up the interior of said tubular structure adjacent said lower end, and within said electrically conductive annular member, and resin means bonding said layer of woven material to said tubular structure, thereby substantially sealing said annular member from the interior space enclosed within said tubular structure, said cloth layer extending partially upwardly within the interior of said tubular structure.

More particularly, it is an objective of the invention to provide an antenna having the foregoing advantages and incorporating a drainage passageway in said base portion, said drainage passageway being formed along a path defining at least one relatively sharp angle.

More particularly, it is an objective of the invention to provide an antenna having the foregoing advantages wherein said tubular structure further comprises an outer surface layer formed of a plurality of strands of glass fibre rovings wound around said tubular structure along a generally helical path, said rovings being wound in a plurality of such helical paths in both directions about said antenna, thereby defining a criss-cross pattern of windings of such rovings, said helical rovings being embedded in resin material.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

Figure 1:
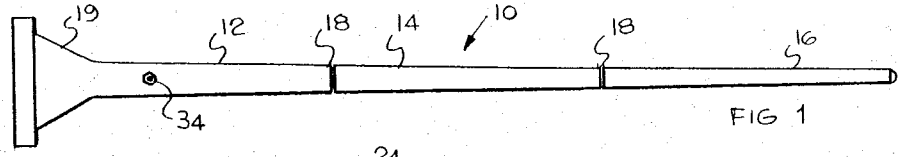
FIG. 1 is a schematic side elevation of a typical multipart whip antenna according to the invention.

The antenna according to the invention may comprise a single section, or two or more sections depending upon the length of the antenna, shipping requirements, and the feasibility of construction techniques. Such an antenna is shown generally as 10 in FIG. 1, having sections 12, 14, and 16, three such sections being illustrated purely by way of example and without limitation.

Couplings 18 connect the sections and provide electrical continuity througout the antenna.

An enlarged base 19 is located at the lower end of the lower section 12, for fastening to a structure, and it has a flattened end surface.

For the purposes of this description, attention is centered principally on the construction of the base section 12, since this section will be essentially the same, whether the antenna consists of a single section, or multiple sections. The only change in the case of a single section antenna would be that there would be no coupling at the upper end of the base section.

Figure 2:
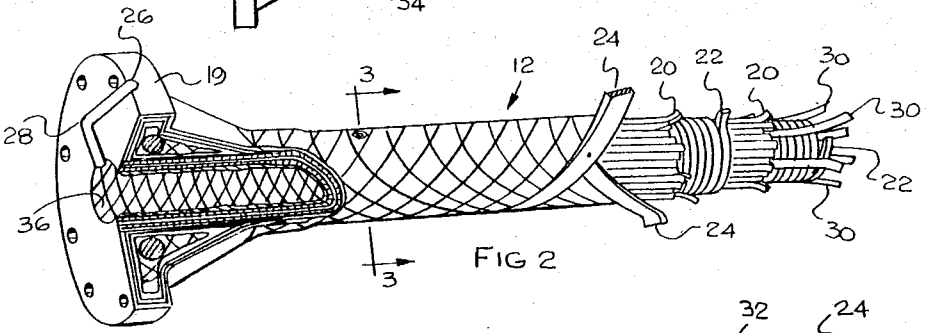
FIG. 2 is a perspective partially cut away showing the construction of a lower portion of the antenna according to the invention.
Figure 3:
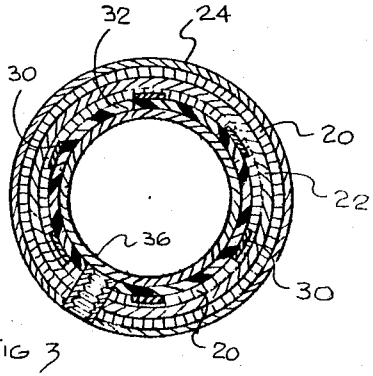
FIG. 3 is a section along the line 3—3 of FIG. 2.
Figure 4:
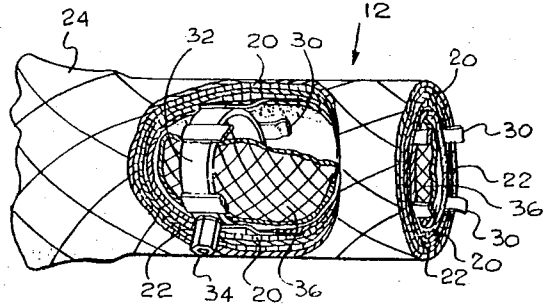
FIG. 4 is a greatly enlarged perspective partially cut away of a portion of the antenna shown in FIG. 2.

As best shown in FIGS. 2, 3 and 4, the construction of the antenna is of an essentially hollow tube construction, the walls of the tube consisting of a plurality of layers of glass fibre rovings. Some of the rovings are arranged as longitudinal rovings 20, and other layers of the rovings are wound circumferentially as at 22, the layers 20 and 22 being arranged alternately so that the circumferential windings essentially bind and hold in place the longitudinal rovings. The rovings are embedded in liquid resin material during the course of manufacture, so that the entire structure sets into a hard solid mass of fibre reinforced resin. The outermost layer consists of a plurality of helical wound rovings 24. These rovings are also passed through a liquid resin bath as they are wound on, so that they set up hard with the remainder of the structure. Such helical rovings 24 are wound in a generally diamond-shaped pattern along the length of the antenna, and in order to fill in the diamond pattern, such rovings may be wound to the extent of four or five, or even six layers. Preferably, in order to provide a more attractive exterior finish, two or three layers will be ground off in a finishing process.

As will be seen from the drawings the antenna structure encloses a hollow interior, and occasionally rain or sea water may enter through the top of the antenna. Accordingly, it is necessary to provide a drainage passageway in the flattened base.

However, the inclusion of such a drainage passageway has been known to create additional problems in that especially when used at sea, the wave action of the sea has tended to cause sea water to surge in through such a drainage passageway, causing an undesirable salt build-up in the interior of the antenna.

In accordance with the invention, this problem is now substantially eliminated by the provision of a drainage passageway in the form shown as 26, in the base portion of the antenna. Such drainage passageway is formed with at least one angle or convolution as at 28. Since the passageway is in any event of quite small dimensions, the existence of the angle or bend in the passageway, between its two ends, effectively reduces the ability of sea water to surge freely along the passageway. The angle creates a degree of turbulence and restriction in the passageway which, without inhibiting the drainage of fluids from within the antenna, restricts the speed with which water can flow in from the outside.

In the construction of the antenna, a plurality of electrically conductive members, in the form of copper strips 30, are incorporated in between the layers of rovings, so that they are substantially completely embedded in the material of the antenna. They are electrically connected, where necessary, to the couplings 18 by any suitable means (not shown). One particularly suitable form of connection is shown in U.S. Pat. No. 4,300,140 (granted to this applicant).

At the lower end of the base section 12 of the antenna, such conductors 30 are electrically connected by means of an electrically conductive ring or cuff 32. This cuff 32 is in turn provided with an electrical connection, in the form of the female threaded socket 34. Socket 34 in the past, had provided a through opening into the interior of the antenna. In addition, the techniques involved in the construction of the antenna meant that the cuff 32 was essentially located within the hollow interior of the antenna. As a result, moisture could gradually enter along the opening in the threaded socket 34, and there was a tendency for salt to build up on the inside of the antenna, in contact with the cuff 32. Such salt created a leakage path, causing significant losses in the efficiency of the antenna.

An additional mechanical problem arose after extensive whipping action of the antenna due to wind and weather. In this case, the cuff 32 in some cases had essentially become loosened from the interior of the antenna and could in some circumstances eventually cause separation of some of the conductors 30.

In addition to all of these problems, the manufacturing techniques involved in making the antenna, essentially as disclosed in U.S. Pat. No. 3,725,944, involved the lay-up of the rovings and resin material on a mandrel. After completion of manufacture, the mandrel was then removed.

The usual so-called "release" agents were applied to the mandrel, but in spite of such agents, it was not unknown for the resin material to become bonded to the mandrel. When the mandrel was removed some breakage of the resin material would occur in some cases.

All of these problems are now avoided by the inclusion of an initial inner layer of glass fibre cloth 36, which extends from the base section 19 upwardly within the interior of the antenna to a point somewhere above the cuff 32. The cloth layer 36 is impregnated with resin, and is applied as the initial layer to the mandrel, after which the cuff 32 is slid over the top, and the construction of the remaining layers of rovings proceeds essentially as described in U.S. Pat. No. 3,725,944.

In this way, the cuff 32 is itself totally embedded within the mass of glass reinforced resin material, and is thus shielded from any contact with salt or other foreign materials within the interior of the antenna. In addition, the inner end of the coupling 34 is also sealed off by the same layer 36.

In addition to these desirable results, it is also found that the woven fabric layer 36 eliminates the problem of breakage of resin materials when the mandrel is removed, thus greatly facilitating the overall manufacturing procedures.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. Free standing antenna for use in severe climatic conditions, such antenna being attached at its base, but being otherwise free of attachment or support, and said antenna being formed with an elongated tubular body portion, having one or more sections, and an enlarged base portion at its lower end for mounting thereof, and said body portion comprising;

a plurality of layers of reinforcing filaments, some of said layers of reinforcing filaments comprising bundles of longitudinal filament rovings running lengthwise along such body portion, and others of said layers of reinforcing filaments comprising generally circumferential windings of filament rovings, said layers of reinforcing filaments being bonded together by resin material;

electrically conductive means embedded in said elongated tubular structure, and running generally from end to end thereof, and terminating adjacent said lower end thereof;

a generally annular electrically conductive member, connected to said electrically conductive means, adjacent said lower end of said tubular structure;

a female threaded metallic electrically conductive socket member connected to said annular member, and extending through a wall of said elongated tubular structure for connection of electrical connection means thereto from the exterior thereof;

at least one layer of woven reinforcing filament cloth material extending up the interior of said tubular structure adjacent said lower end, and overlying the interior of said annular member, and, resin means bonding said layer of woven cloth material to the interior of said tubular structure, and to the interior of said annular member, thereby substantially embedding and enclosing said annular member.

2. A free standing antenna as claimed in claim 1 wherein said base portion defines a generally flattened undersurface and including drain passage means formed in said flattened undersurface for drainage of liquids from the interior of said tubular structure.

3. A free standing antenna as claimed in claim 2 wherein said drainage passage defines at least one relatively sharp angle whereby to reduce rapid surging of liquids into said passage from the exterior during inclement weather.

4. A free standing antenna as claimed in claim 1 wherein said tubular structure further comprises an outer surface layer formed of a plurality of strands of reinforcing filament rovings wound around said tubular structure is a plurality of generally helical halves spaced apart from one another, and some such helical windings being directed in the opposite direction to others, whereby to define a generally criss-cross pattern of windings of such rovings and resin material embedding said helical windings and bonding them to said tubular structure.

* * * * *